US006237993B1

(12) United States Patent
Zheng

(10) Patent No.: US 6,237,993 B1
(45) Date of Patent: May 29, 2001

(54) FOLDABLE FRAME FOR BEACH CHAIR

(76) Inventor: Edward Zheng, 1736 Wright Ave., La Verne, CA (US) 91750

( * ) Notice: Subject to any disclaimer, the term of this patent is extended or adjusted under 35 U.S.C. 154(b) by 0 days.

(21) Appl. No.: 09/483,379

(22) Filed: Jan. 12, 2000

(51) Int. Cl.[7] ..... A47C 4/38
(52) U.S. Cl. ..... 297/16.2; 297/45
(58) Field of Search ..... 297/16.1, 16.2, 297/45, 59; 248/164, 432

(56) References Cited

U.S. PATENT DOCUMENTS 467,340 * 1/1892 Chichester ..... 248/432
2,625,207 * 1/1953 Duke ..... 297/45
2,691,410 * 10/1954 Boucher ..... 297/440.11 X
5,499,857 * 3/1996 Lynch, Jr. ..... 297/16.2

FOREIGN PATENT DOCUMENTS

2532535 * 3/1984 (FR) ..... 297/16.2

* cited by examiner

*Primary Examiner*—Peter R. Brown
(74) *Attorney, Agent, or Firm*—Raymond Y. Chan; David and Raymond Patent Group

(57) ABSTRACT

A foldable frame for beach chair, which comprises a seat frame and a back frame foldably coupled with the seat frame, wherein a pair of foldable supporting arms each having a pivot end pivotally connected with one of the two crossed side frame legs of the respective pair of side frame legs of the seat frame in such a manner that a supporting end of each of the supporting arms is extended to bias against the other side frame legs of the respective pair of side frame legs when the foldable frame is unfolded to stretch out. Therefore, the foldable frame provides a low height strong frame structure that can well support the user's weight of the user.

30 Claims, 10 Drawing Sheets

FOLDABLE FRAME FOR BEACH CHAIR

BACKGROUND OF THE INVENTION

1. Field of Invention

The present invention relates to a frame of a beach chair, and more particularly to a foldable beach chair frame with an inclined back frame which is facilitated to be folded into a compact unit for storage and carriage.

2. Description of Related Arts

The distinctive feature of a beach chair is its low height. Normally, a beach chair merely has half the height of a normal chair. FIG. 1A illustrates a conventional folding chair. If its height is reduced to a half, the angle between each of the inclined legs with the ground must be reduced to a half too, that will damage its supporting structure to largely decrease the supporting ability thereof while maintaining the same width of the folding chair. In other words, the cross tube structure of the conventional folding chair, as shown in FIG. 1A, limits the height of the chair.

Therefore, due to the low height requirement of the beach chair, as shown in FIGS. 2A and 2B, the common foldable beach chair comprises a chair seat A2 which is made of durable fabric and a chair frame A1 which is constructed by a set of metal tubes. The chair frame A1 for supporting the chair seat A2 comprises a seat frame section A12, a back frame section A13 pivotally mounted to the seat frame section A12, a leg frame section A14 for supporting the seat frame section A12 pivotally mounted underneath the seat frame section A12, and a pair of pivotal arms A15 each pivotally connecting between the seat frame section A12 and the back frame section A13. In order to fold the conventional foldable beach chair, fold the back frame section A13 toward the seat frame section A12 by rotating the pivotal arms A15 outwardly and fold the leg frame section A14 underneath and into the seat frame section A12. The folded beach chair is bulky and difficult to carry because the size of the beach chair is limited by its seat frame section A12. Also, the beach chair is usually heavy since the chair frame A1 must be constructed sturdily in order to support a user's weight.

SUMMARY OF THE INVENTION

A main object of the present invention is to provide a foldable frame for beach chair, which provides a low height strong frame structure that can well support the user's weight of the user.

Another object of the present invention is to provide a foldable frame for beach chair, which comprises an inclined back frame structure to enable the user's back to comfortably lie on the beach chair.

Another object of the present invention is to provide a foldable frame for beach chair, which has a simple construction that every individual is able to fold and unfold the beach chair in one single motion.

Another object of the present invention is to provide a foldable frame for beach chair, which is adapted for being folded into a compact unit for easily storage and carriage.

Accordingly, in order to accomplish the above objects, the present invention provides a foldable frame for beach chair, which comprises a seat frame and a back frame foldably coupled with the seat frame, wherein the seat frame comprises:

a pair of front frame legs pivotally connected with each other in cross manner to form a "X" structure;

a pair of back frame legs pivotally connected with each other in cross manner to form a "X" structure two pairs of side frame legs, wherein each pair of side frame legs are pivotally connected with each other in cross manner to form a "X" structure;

a pair of front lower frame joints for pivotally connecting two lower ends of the two front frame legs with two lower front ends of the side frame legs respectively;

a pair of back lower frame joints for pivotally connecting two lower ends of the two back frame legs with two lower back ends of the side frame legs respectively;

a pair of front upper frame joints for pivotally connecting two upper ends of the two front frame legs with two upper front ends of the side frame legs respectively;

a pair of back upper frame joints for pivotally connecting two upper ends of the two back frame legs with two upper back ends of the side frame legs respectively; and a pair of foldable supporting arms each having a pivot end pivotally connected with one of the two crossed side frame legs of the respective pair of side frame legs in such a manner that a supporting end of each of the supporting arms is extended to bias against the other side frame legs of the respective pair of side frame legs when the foldable frame is unfolded to stretch out.

DETAILED DESCRIPTION OF THE PREFERRED EMBODIMENT

Figure 1:
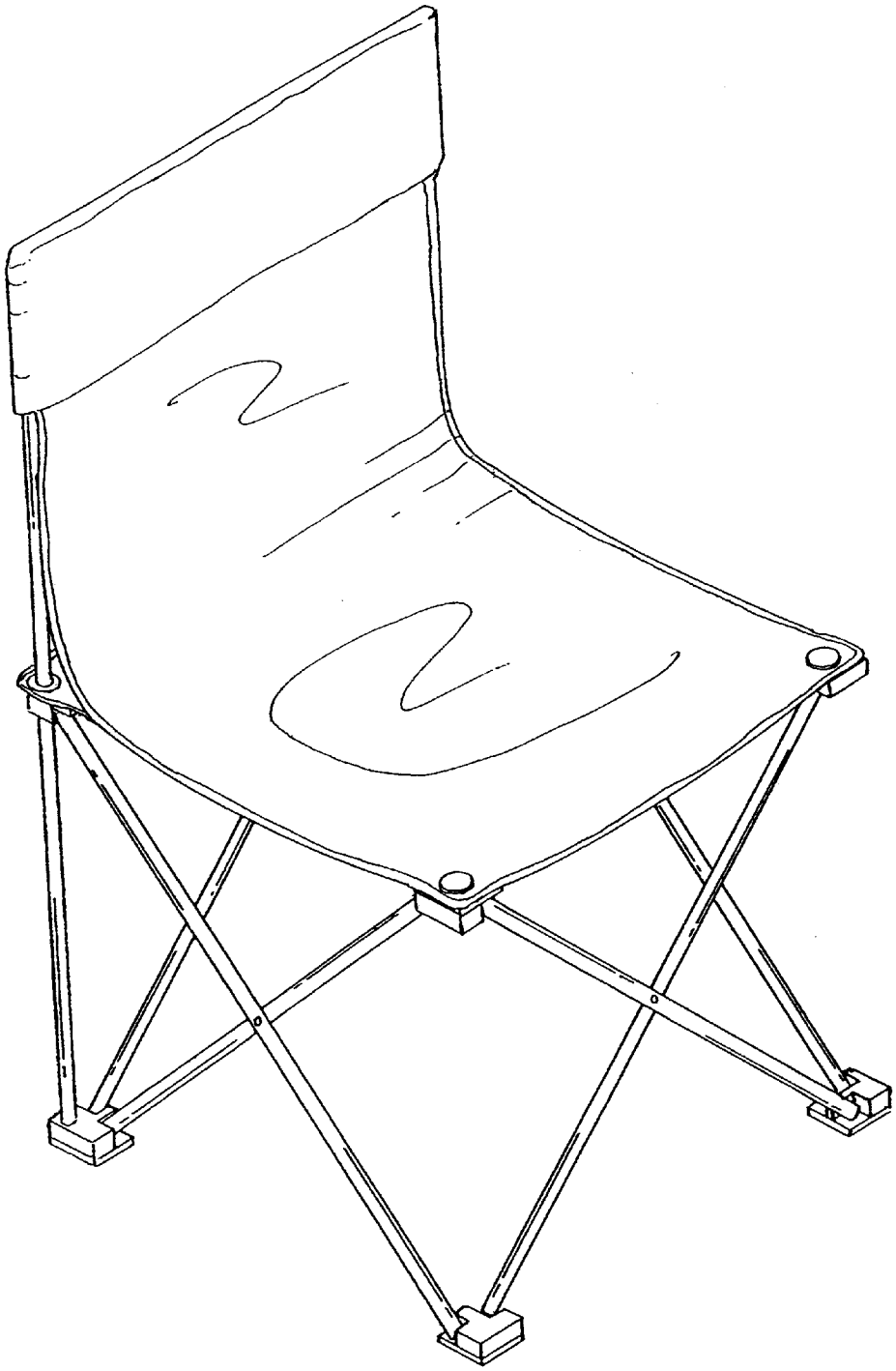
FIG 1 Prior Art
FIG. 1 is a perspective view of a conventional folding chair.
Figure 2A:
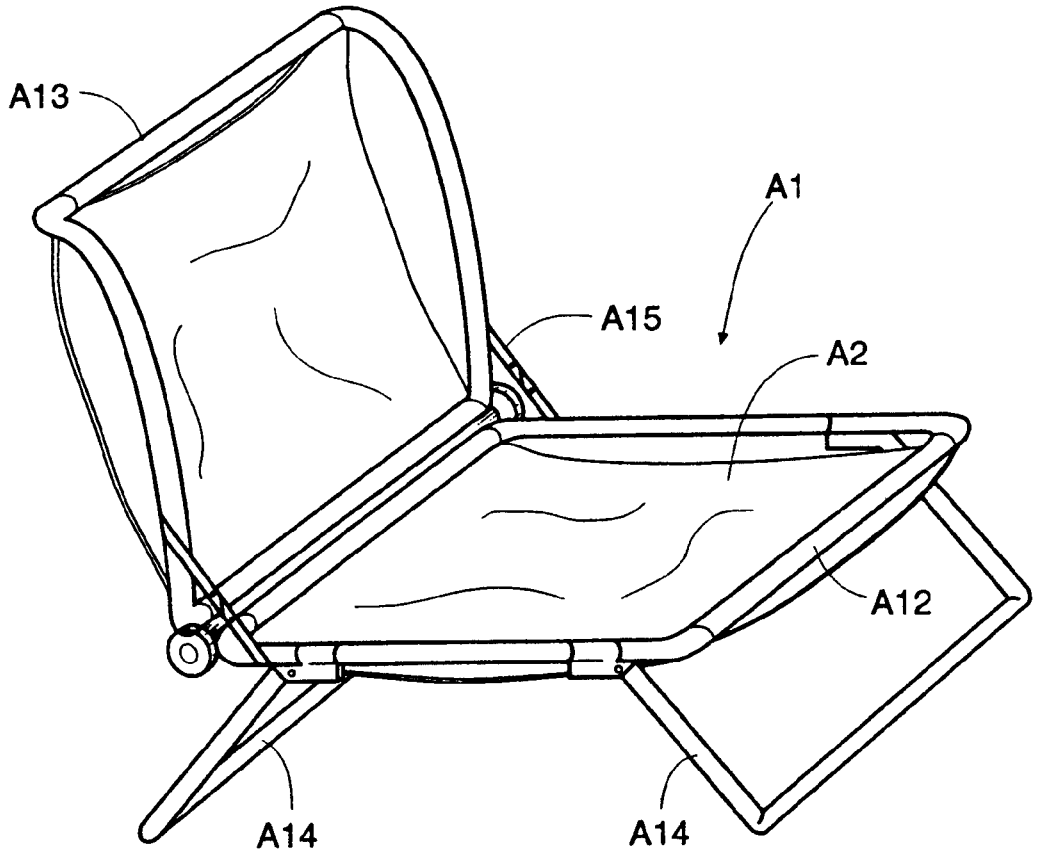
FIG 2A Prior Art
FIG. 2A is a perspective view of a conventional foldable beach chair in the unfolded state.
Figure 2B:
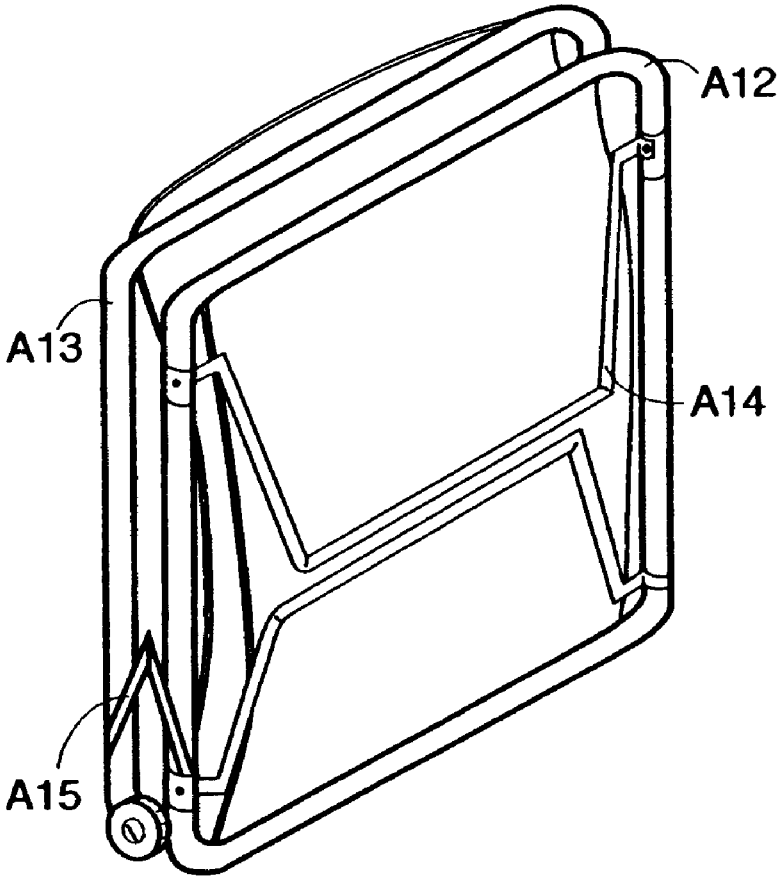
FIG 2B Prior Art
FIG. 2B a perspective view of the conventional foldable beach chair in the folded state.
Figure 3:
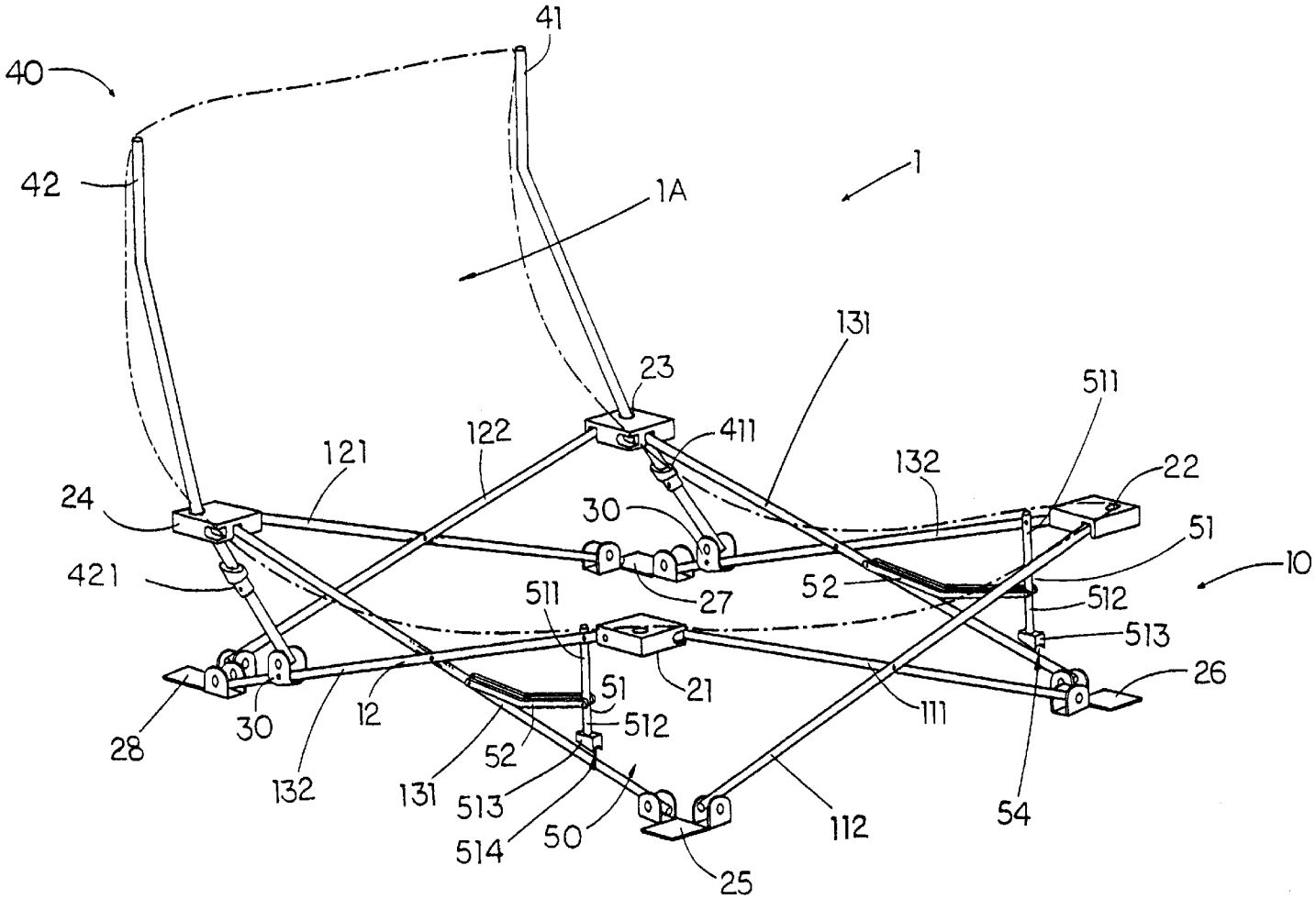
FIG. 3 is a perspective view of a foldable frame for beach chair according to a preferred embodiment of the present invention.

Referring to FIG. 3 of the drawings, a foldable frame 1 for a fabric seat 1A to mount thereon to form a beach chair. The foldable frame 1 comprises a seat frame 10 and a back frame 40 foldably coupled with the seat frame 10.

The seat frame 10 comprises a pair of front frame legs 111, 112 pivotally connected with each other in cross manner to form a "X" structure; a pair of back frame legs 121, 122 pivotally connected with each other in cross manner to form a "X" structure; and two pairs of side frame legs 131, 132, wherein each pair of side frame legs 131, 132 are pivotally connected with each other in cross manner to form a "X" structure.

The seat frame 10 further comprises a pair of front upper frame joints 21, 22, a pair of back upper frame joints 23, 24, a pair of front lower frame joints 25, 26, and a pair of back lower frame joints 27, 28.

The pair of front upper frame joints 21, 22 are adapted for pivotally connecting two upper ends of the two front frame legs 111, 121 with two upper front ends of the side frame legs 132 respectively. The pair of back upper frame joints 23, 24 are adapted for pivotally connecting two upper ends of the two back frame legs 122, 121 with two upper back ends of the side frame legs 131 respectively. The pair of front lower frame joints 25, 26 are adapted for pivotally connecting two lower ends of the two front frame legs 112, 111 with two lower front ends of the side frame legs 131 respectively. The pair of back lower frame joints 27, 28 for pivotally connecting two lower ends of the two back frame legs 121, 122 with two lower back ends of the side frame legs 132 respectively.

The back frame 40 comprises a pair of inclined back frame legs 41, 42 slidably penetrating through the two back upper frame joints 23, 24 respectively, wherein two lower ends of the two back frame legs 41, 42 are respectively extended downwardly to pivotally connected to two U-shaped pivot joints 30 which are affixed to a lower portion of the two side frame legs 132 respectively. The inclination of the back frame 40 depends on where the two pivot joints 30 connect with the two side frame legs 132. Substantially, the back frame 40 will be more inclined with respect to the seat frame when the two lower ends of the two back frame legs 41, 42 are connected with the upper portions of the two side frame legs 132 through the pivot joints 30 respectively. Also, the back frame 40 becomes more vertical when the two pivot joints 30 are affixed to the two side frame legs 132 at a position closer to the two back lower frame joints 27, 28.

The back frame 40 further comprises a pair of ring shaped stoppers 411, 421 respectively affixed at the lower portions of the two back frame legs 41, 42, positioning between the two back upper frame joints 23, 24 and the two pivot joints 30. The two stoppers 411, 421 are used to block and stop the downward movement of the two back upper frame joints 23, 24 while unfolding and stretching out the foldable frame 1, so as to lock up the height of the beach chair and partially support the weight of the user.

Figure 4:
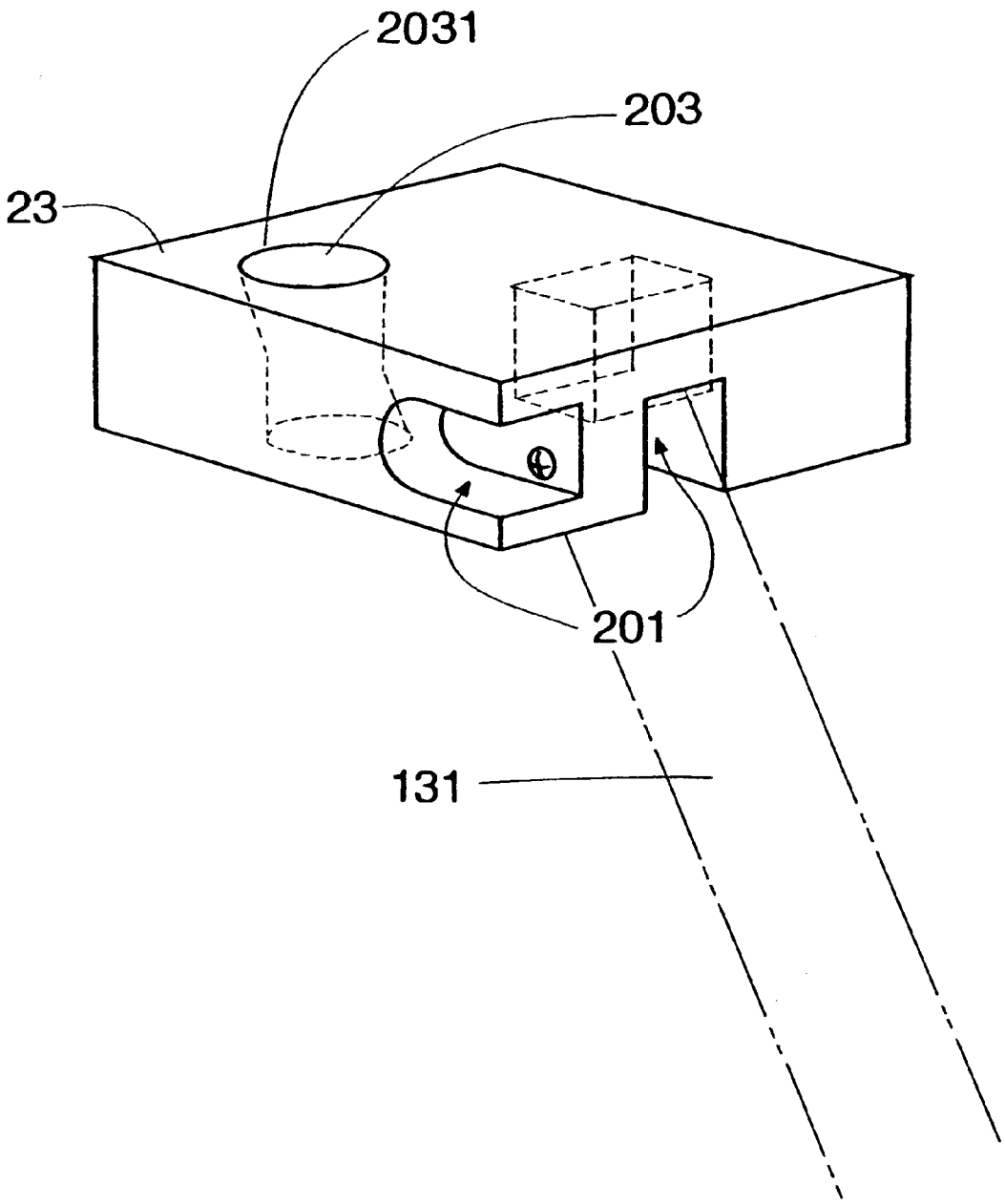
FIG. 4 is a perspective view of the back upper frame joint of the foldable frame for beach according to the above preferred embodiment of the present invention.

As shown in FIG. 4, each of the back upper frame joints 23, 24 has a first pivot slot 201 and a second pivot slot 202 for pivotally connecting with the respective side frame leg 132 and the respective back frame leg 121, 122 respectively, and a guiding through hole 203 having an inclined support surface 2031 for supporting the respective inclined back frame leg 42 during the unfolded state, so as to evenly distribute a downward force applied by the user's weight and minimize a stress around the back upper frame joints 23, 24.

Figure 5:
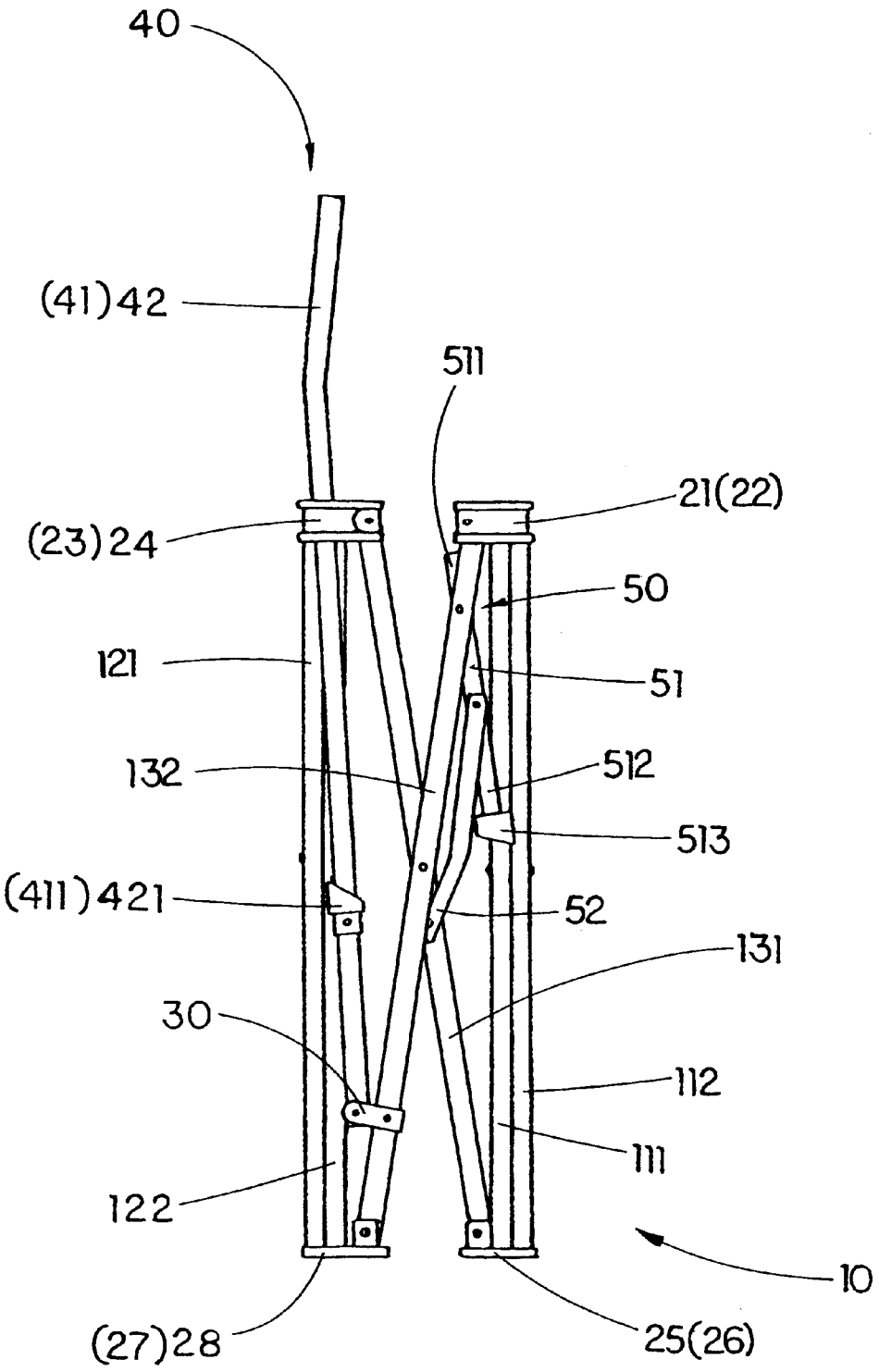
FIG. 5 is a perspective view of the foldable frame for a beach chair in the folded state according to the above preferred embodiment of the present invention.

As shown in FIGS. 3 to 9, the folding frame 1 of the present invention further comprises a foldable supporting means 50 for mainly supporting the user's weight applied to the front portion of the seat frame 10 in such a manner that the foldable supporting means can also be folded up when the entire folding frame 1 is folded up as shown in FIG. 5. The foldable supporting means 50 comprises a pair of foldable supporting arms 51 each having a pivot end 511 pivotally connected with one of the two crossed side frame legs 131 or 132 of the respective pair of side frame legs in such a manner that a supporting end 512 of each of the supporting arms 51 is extended to bias against the other side frame legs 131 or 132 of the respective pair of side frame legs when the foldable frame 1 is unfolded to stretch out.

Figure 6:
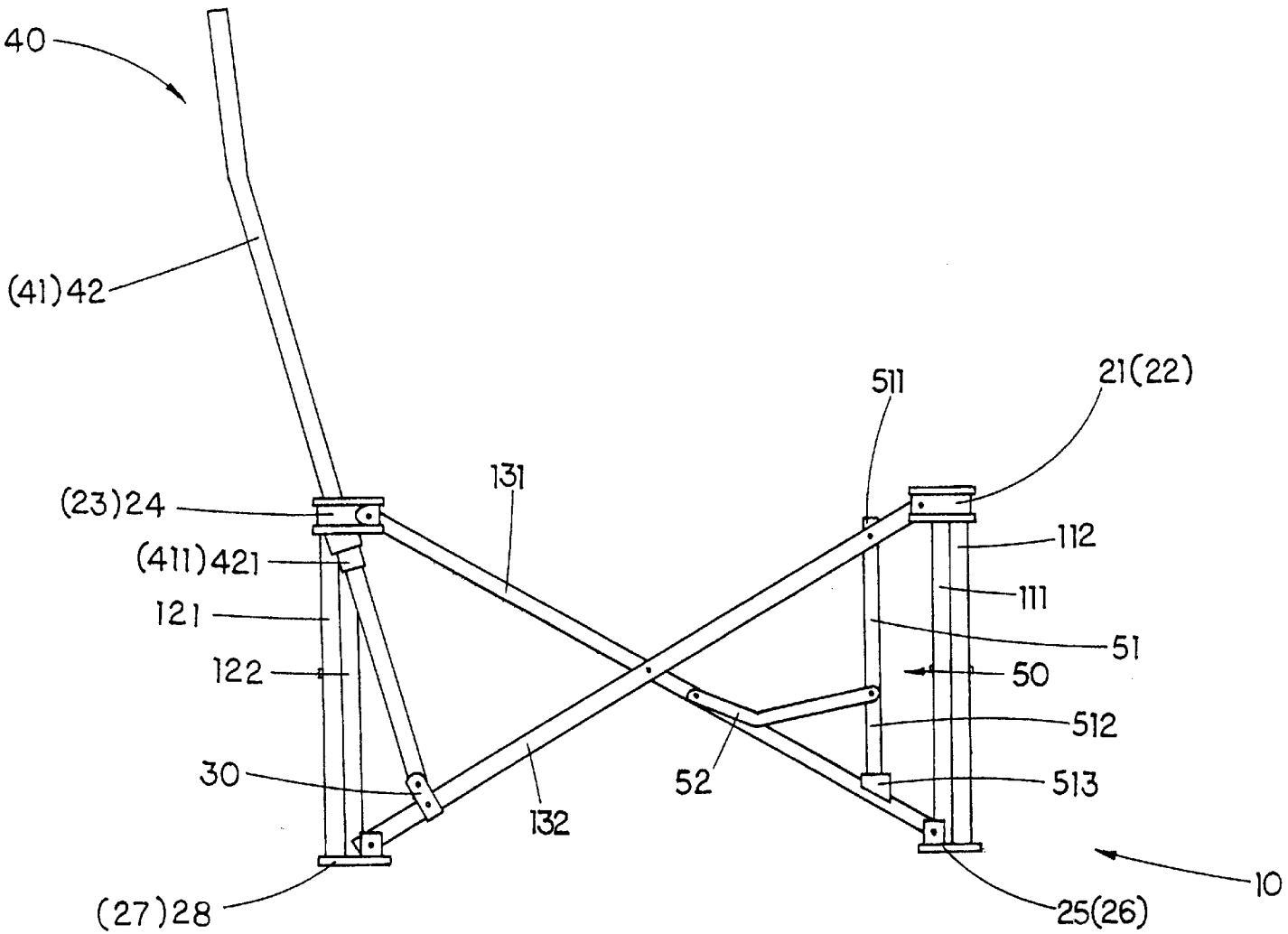
FIG. 6 is a side view of the unfolded foldable frame for beach chair according to the above preferred embodiment of the present invention.

According to the preferred embodiment of the present invention as shown in FIGS. 3, 5 and 6, the two pivot ends 511 of the two supporting arms 51 are pivotally connected to the upper portions of the two upwardly and frontwardly extending side frame legs 132 respectively. In addition, the two supporting ends 512 of the two supporting arms 51 are suspended downwardly in such a manner that each of the two supporting arms 51 has a length adapted to press against the other side frame legs 131 vertically when the foldable frame 1 is in the unfolded state as shown in FIG. 6, so as to strengthen the cross-structure of the two pairs of side frame legs 131, 132 and support the user's weight applied to the front portion of the beach chair and limit distance between the two front upper frame joints 21, 22 and front lower frame joints 25, 26, i.e. the height of the beach chair.

In order to steadily rest on the side frame legs 131, each of the two supporting arms 51 further has an enlarged rest head 513 affixed to the supporting end 512 thereof, wherein each of the rest heads 513 has an inclined end arc surface 514 adapted to sit on the upper curved surface of the respective side frame leg 131 as shown in FIG. 6.

In addition, in order to ensure the supporting arms 51 being vertically supported between the two side frame legs 131, 132 when the foldable frame 1 is in the unfolded state as shown in FIG. 6, and also being vertically folded up when the foldable frame 1 is in the folded state as shown in FIG. 5, the supporting means 50 further comprises a pair of guider arms 52 for guiding and maintaining the supporting arms 51 to fold and unfold in a vertical manner. One end of each of the guider arms 52 is pivotally connected to a middle position of the respective supporting arm 51 which is pivotally extended from the upper side frame leg 132 while another end of each of the guider arms 52 is pivotally connected to an adequate position of the other side frame leg 131. According to the preferred embodiment, each of the guider arms 52 comprises a pair of bent metal plates arranged in parallel manner.

Therefore, when the user is unfolding the foldable frame 1 from its unfolded state as shown in FIG. 5, the two guider arms 52 will push and guide the two supporting arms 51 to its strongest vertical support position as shown in FIGS. 3 and 6. Also, during the folding operation, the two guider arms 52 will pull and guide the two supporting arms to remain in vertical position so as to save the folding space.

Furthermore, the length of the pair of supporting arms 51 determines the height of the foldable frame 1 of the beach chair, i.e. the shorter of the supporting arms, the lower of the beach chair. It is worth to mention that, referring to FIG. 5, when the foldable frame 1 is folded, the side frame legs 131, 132 rotate in a scissors-like manner, narrowing the cross structure of each pair of front frame legs 111, 112 to near vertical position, as the circumference of the foldable beach chair frame 1 is reduced and the height is lengthened. The two back upper frame joints 23, 24 slide upwardly along the two back frame legs 41, 42 so as to pivot the back frame 40 in the vertical position. Each guider arm 52 guides the supporting arm 51 to rotate toward the circumference of the foldable frame 1 while folding the pairs of front, back and side frame legs 111, 112, 121, 122, 131, 132 in scissors-like manner.

Figure 7:
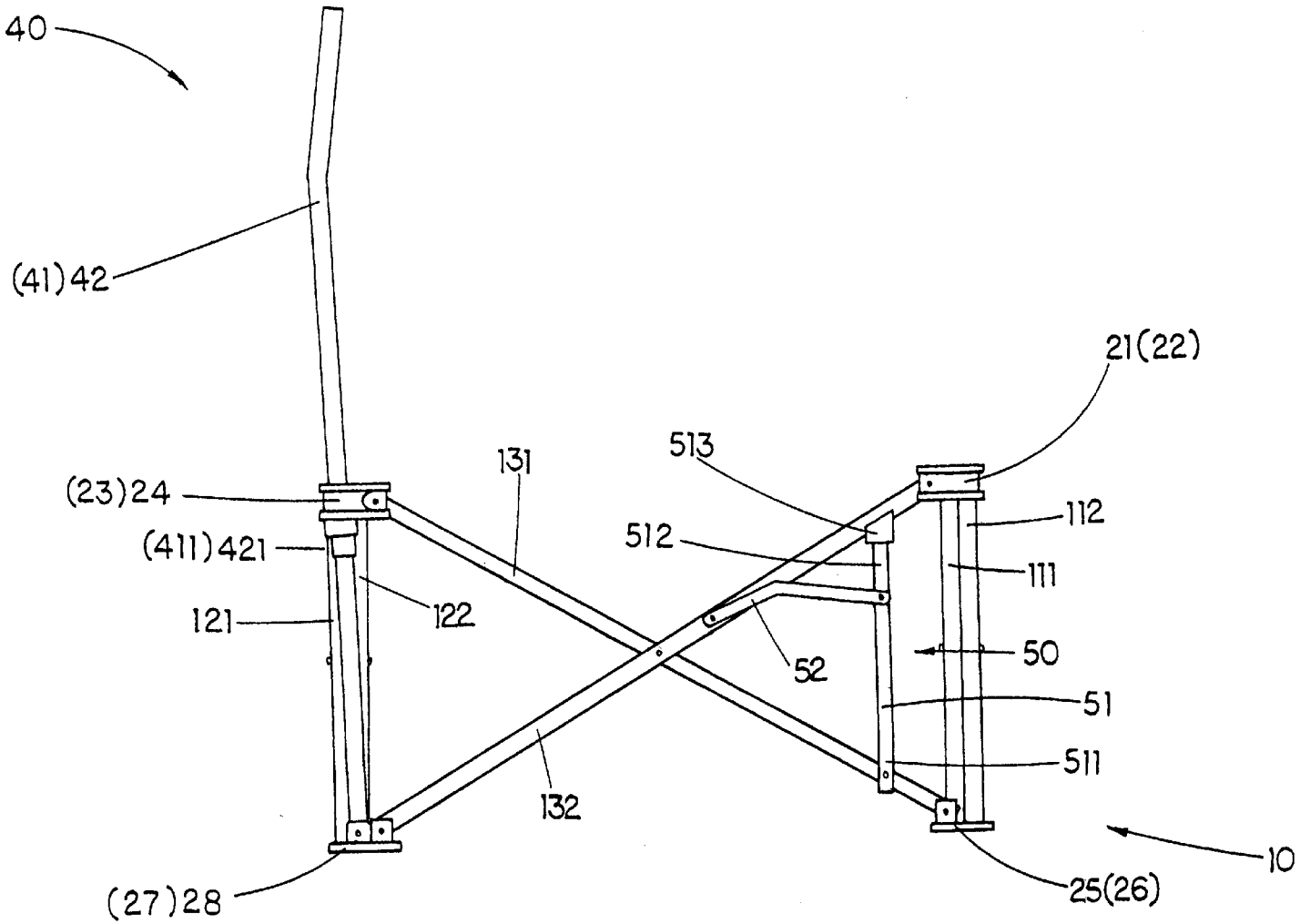
FIG. 7 is a side view of a first alternative mode of the foldable frame for beach chair according to the above preferred embodiment of the present invention.

Referring to FIG. 7, a first alternative mode of the above preferred embodiment of the present invention is illustrated, wherein the supporting means 50' is modified to have the pivot ends 511' of the two supporting arms 51' pivotally connected to the two frontwardly and downwardly extending side frame legs 131 respectively instead of the upper side frame legs 132 as described in the above preferred embodiment as shown in FIGS. 3 to 6, so that the two supporting ends 512' and the two rest heads 513' are pointing upwards adapted to press and bias against the upper side frame legs 132 respectively during the unfolded state as shown in FIG. 7. Moreover, one end of each of the guider arms 52' is pivotally connected to the respective upper side frame leg 132. Accordingly, when unfolding the foldable frame 1', each of the guider arms 52' will guide the respective supporting arm 51' pivotally slide upward to bias the respective upper side frame leg 132 by its rest head 513'. In other words, the alternative supporting means 50' of the foldable frame 1' works and functions identical to the above preferred embodiment. Besides, the foldable frame 1' as shown in FIG. 7 also illustrates that the two lower ends of the two back frame legs 41, 42 are alternatively connected to the two back lower frame joints 27, 28.

Figure 8:
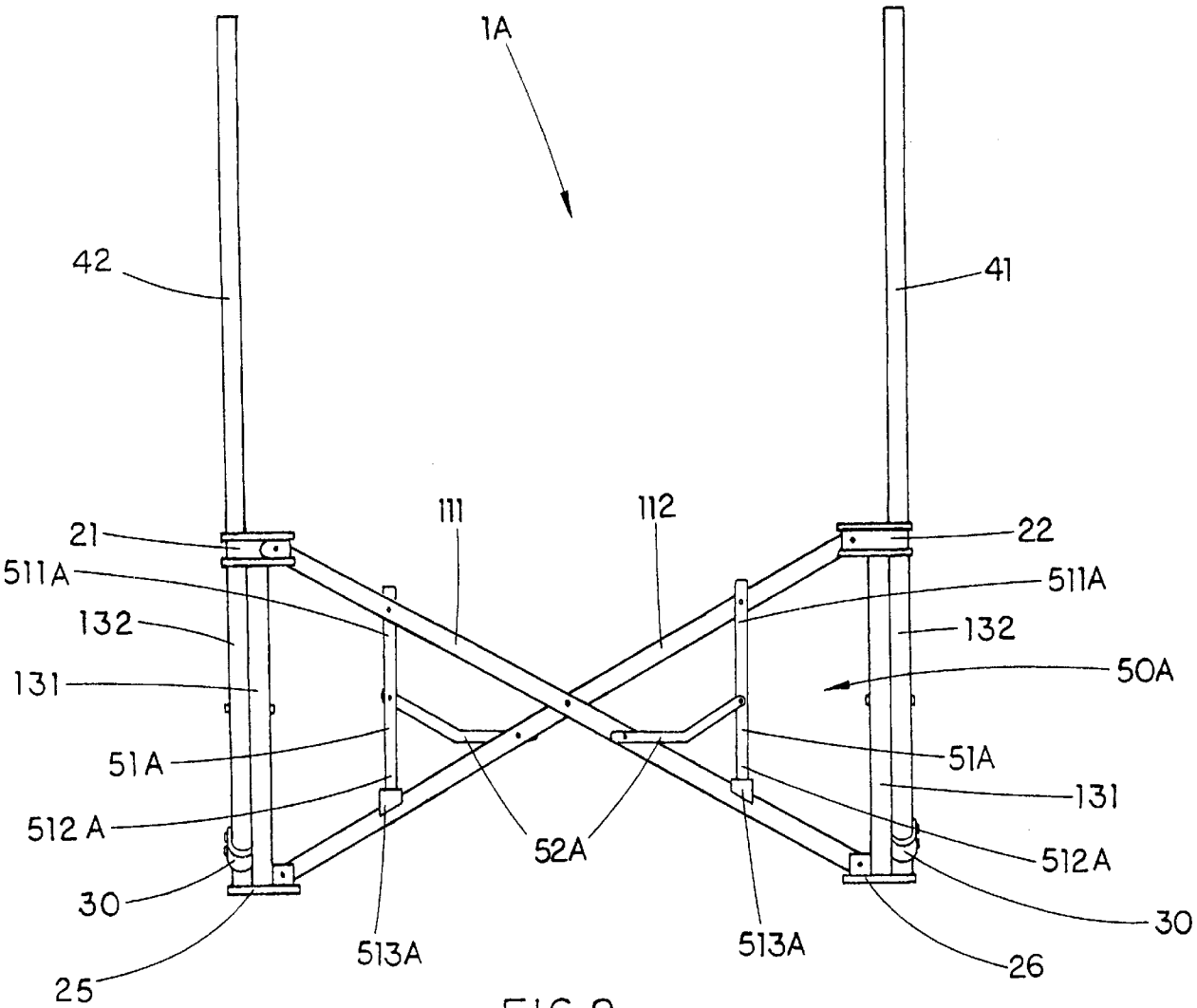
FIG. 8 is a front view of a second alternative mode of the foldable frame for beach chair according to the above preferred embodiment of the present invention.

Referring to FIG. 8, a second alternative mode of the above preferred embodiment of the present invention is illustrated, wherein the supporting means 50*a* is modified to install between the pair of front frame legs 111, 112. In which, the pivot ends 511*a* of the two supporting arms 51*a* pivotally connected to the upper portions of the two front frame legs 111, 112 respectively, so that the two supporting ends 512*a* and the two rest heads 513*a* are vertically extended downwardly to press and bias against the lower portions of the other front frame legs 112, 111 respectively during the unfolded state as shown in FIG. 8. Moreover, one end of each of the guider arms 52*a* is pivotally connected to the respective front frame leg 111, 112 while the other end of each of the guider arms 52*a* is pivotally connected to the respective supporting arm 51*a*. Accordingly, when unfolding the foldable frame 1*a*, each of the guider arms 52*a* will guide the respective supporting arm 51*a* pivotally slide downward to bias the respective front frame leg 111, 112 by its rest head 513*a*.

Figure 9:
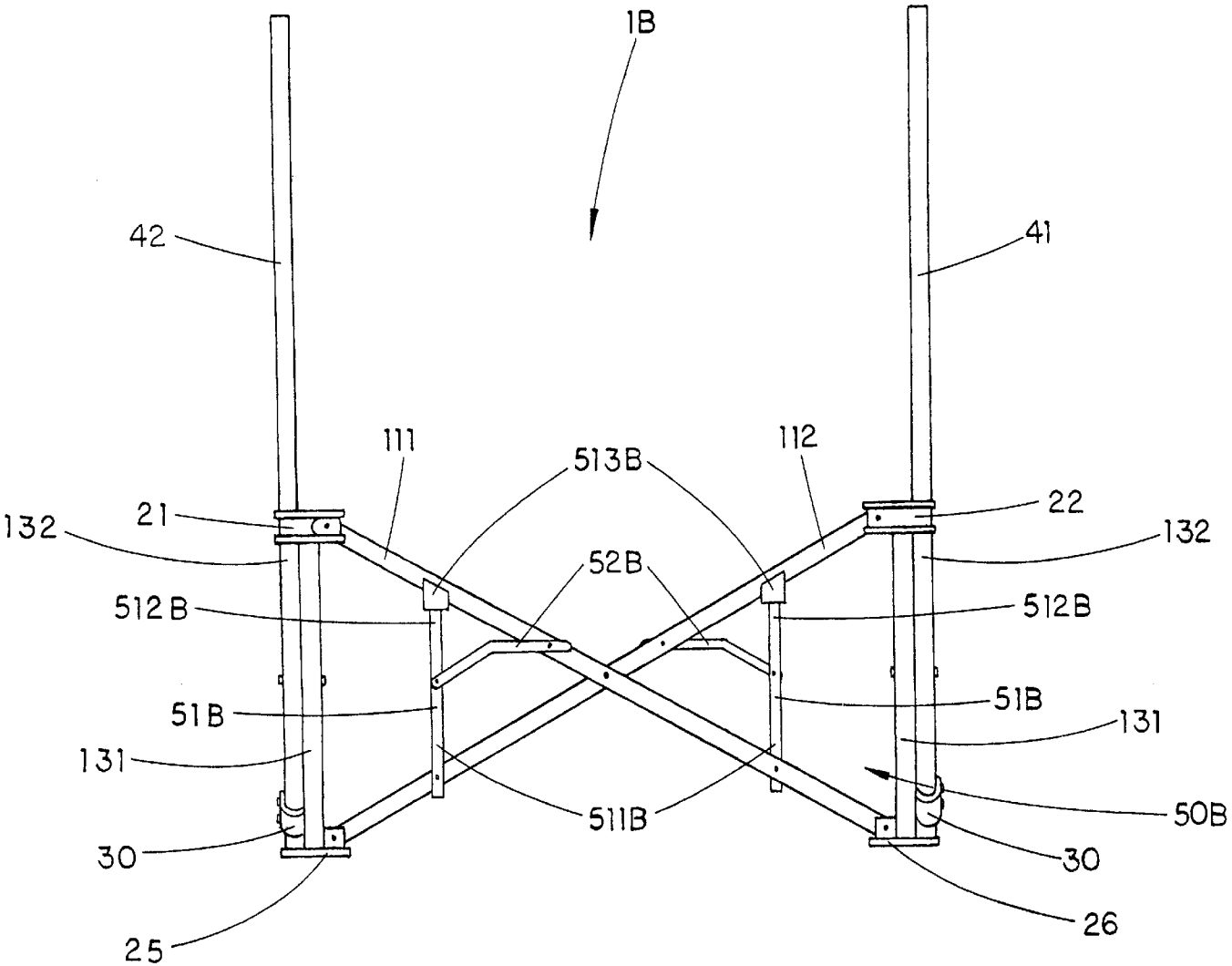
FIG. 9 is a front view of a third alternative mode of the foldable frame for beach chair according to the above preferred embodiment of the present invention.

Referring to FIG. 9, a third alternative mode of the above preferred embodiment of the present invention is illustrated, wherein the supporting means 50*b* is modified from the supporting means 50*a* of the above second alternative mode. In which, the pivot ends 511*b* of the two supporting arms 51*b* pivotally connected to the lower portions of the two front frame legs 111, 112 respectively, so that the two supporting ends 512*b* and the two rest heads 513*b* are vertically extended upwardly to press and bias against the upper portions of the other front frame legs 112, 111 respectively during the unfolded state as shown in FIG. 9. Moreover, one end of each of the guider arms 52*b* is pivotally connected to the respective front frame leg 111, 112 while the other end of each of the guider arms 52*b* is pivotally connected to the respective supporting arm 51*b*. Accordingly, when unfolding the foldable frame 1*b*, each of the guider arms 52*b* will guide the respective supporting arm 51*b* pivotally slide upward to bias the respective front frame leg 111, 112 by its rest head 513*b*.

What is claimed is:

1. A foldable frame for beach chair, comprising:

a pair of front frame legs pivotally connected with each other in a cross manner to form a pivotal "X" structure;

a pair of back frame legs pivotally connected with each other in a cross manner to form a pivotal "X" structure two pairs of side frame legs, each pair comprising a first side frame leg and a second side frame leg pivotally connected with each other in a cross manner to form a pivotal "X" structure;

a pair of front lower frame joints for pivotally connecting two lower ends of said two front frame legs with two lower front ends of said side frame legs respectively;

a pair of back lower frame joints for pivotally connecting two lower ends of said two back frame legs with two lower back ends of said side frame legs respectively;

a pair of front upper frame joints for pivotally connecting two upper ends of said two front frame legs with two upper front ends of said side frame legs respectively;

a pair of back upper frame joints for pivotally connecting two upper ends of said two back frame legs with two upper back ends of said side frame legs respectively; and a pair of foldable supporting arms each having a pivot end pivotally connected with one of said two crossed side frame legs of said respective pair of side frame legs in such a manner that a supporting end of each of said supporting arms is extended to bias against said other side frame legs of said respective pair of side frame legs when said foldable frame is unfolded to stretch out, wherein said two pivot ends of said two supporting arms are pivotally connected to upper portions of said two first side frame legs, which are frontwardly extending upwardly, respectively, wherein said two supporting ends of said two supporting arms are suspended downwardly in such a manner that each of said two supporting arms has a length and vertically presses against said two second side frame legs respectively when said foldable frame is unfolded to stretch out.

2. The foldable frame, as recited in claim 1, wherein each of said two supporting arms further has an enlarged rest head affixed to said supporting end thereof to steadily press and bias against said two second side frame legs respectively.

3. The foldable frame, as recited in claim 2, wherein each of said rest heads has an inclined end arc surface adapted to sit on an upper curved surface of said respective second side frame leg.

4. The foldable frame, as recited in claim 1, further comprising a pair of inclined back frame legs slidably penetrating through said two back upper frame joints respectively, wherein two lower ends of said two back frame legs are respectively extended downwardly to pivotally connected to two pivot joints which are affixed to a lower portion of said two side frame legs respectively, moreover a pair of stoppers are respectively affixed at lower portions of said two back frame legs, positioning between said two back upper frame joints and said two pivot joints, so as to block and stop downward movement of said two back upper frame joints while unfolding and stretching out said foldable frame.

5. A foldable frame for beach chair, comprising:

a pair of front frame legs pivotally connected with each other in a cross manner to form a pivotal "X" structure;

a pair of back frame legs pivotally connected with each other in a cross manner to form a pivotal "X" structure two pairs of side frame legs, each pair comprising a first side frame leg and a second side frame leg pivotally connected with each other in a cross manner to form a pivotal "X" structure;

a pair of front lower frame joints for pivotally connecting two lower ends of said two front frame legs with two lower front ends of said side frame legs respectively;

a pair of back lower frame joints for pivotally connecting two lower ends of said two back frame legs with two lower back ends of said side frame legs respectively;

a pair of front upper frame joints for pivotally connecting two upper ends of said two front frame legs with two upper front ends of said side frame legs respectively;

a pair of back upper frame joints for pivotally connecting two upper ends of said two back frame legs with two upper back ends of said side frame legs respectively;

a pair of foldable supporting arms each having a pivot end pivotally connected with one of said two crossed side frame legs of said respective pair of side frame legs in such a manner that a supporting end of each of said supporting arms is extended to bias against said other side frame legs of said respective pair of side frame legs when said foldable frame is unfolded to stretch out, wherein said two pivot ends of said two supporting arms are pivotally connected to upper portions of said two first side frame legs, which are frontwardly extending upwardly, respectively, wherein said two pivot ends of said two supporting arms are pivotally connected to upper portions of said two first side frame legs, which are frontwardly extending upwardly, respectively, wherein said two supporting ends of said two supporting arms are suspended downwardly in such a manner that each of said two supporting arms has a length and vertically presses against said two second side frame legs respectively when said foldable frame is unfolded to stretch out; and a pair of guider arms for guiding and maintaining said supporting arms to fold and unfold in a vertical manner, wherein one end of each of said guider arms is pivotally connected to a middle position of said respective supporting arm which is pivotally extended from said first side frame leg while another end of each of said guider arms is pivotally connected to said second side frame leg of the same pair of said side frame legs.

6. The foldable frame, as recited in claim 5, wherein each of said two supporting arms further has an enlarged rest head affixed to said supporting end thereof to steadily press and bias against said two second side frame legs respectively.

7. The foldable frame, as recited in claim 6, wherein each of said rest heads has an inclined end arc surface adapted to sit on a lower curved surface of said respective second side frame leg.

8. The foldable frame, as recited in claim 5, further comprising a pair of inclined back frame legs slidably penetrating through said two back upper frame joints respectively, wherein two lower ends of said two back frame legs are respectively extended downwardly to pivotally connected to two pivot joints which are affixed to a lower portion of said two side frame legs respectively, moreover a pair of stoppers are respectively affixed at lower portions of said two back frame legs, positioning between said two back upper frame joints and said two pivot joints, so as to block and stop downward movement of said two back upper frame joints while unfolding and stretching out said foldable frame.

9. A foldable frame for beach chair, comprising:

a pair of front frame legs pivotally connected with each other in a cross manner to form a pivotal "X" structure;

a pair of back frame legs pivotally connected with each other in a cross manner to form a pivotal "X" structure two pairs of side frame legs, each pair comprising a first side frame leg and a second side frame leg pivotally connected with each other in a cross manner to form a pivotal "X" structure;

a pair of front lower frame joints for pivotally connecting two lower ends of said two front frame legs with two lower front ends of said side frame legs respectively;

a pair of back lower frame joints for pivotally connecting two lower ends of said two back frame legs with two lower back ends of said side frame legs respectively;

a pair of front upper frame joints for pivotally connecting two upper ends of said two front frame legs with two upper front ends of said side frame legs respectively;

a pair of back upper frame joints for pivotally connecting two upper ends of said two back frame legs with two upper back ends of said side frame legs respectively; and a pair of foldable supporting arms each having a pivot end pivotally connected with one of said two crossed side frame legs of said respective pair of side frame legs in such a manner that a supporting end of each of said supporting arms is extended to bias against said other side frame legs of said respective pair of side frame legs when said foldable frame is unfolded to stretch out, wherein said two pivot ends of said two supporting arms are pivotally connected to upper portions of said two first side frame legs, which are frontwardly extending upwardly, respectively; wherein said two pivot ends of said two supporting arms are pivotally connected to said two second side frame legs, which are frontwardly extending downwardly, respectively, wherein said two supporting ends are extended upwardly in such a manner that each of said two supporting arms has a length and vertically presses against said two first side frame legs respectively when said foldable frame is unfolded to stretch out.

10. A foldable frame for beach chair, as recited in claim 9, wherein each of said two supporting arms further has an enlarged rest head affixed to said supporting end thereof to steadily press and bias against said two first side frame legs respectively.

11. A foldable frame for beach chair, as recited in claim 10, wherein each of said rest heads has an inclined end arc surface adapted to sit on said upper curved surface of said respective first side frame leg.

12. The foldable frame, as recited in claim 9, further comprising a pair of inclined back frame legs slidably penetrating through said two back upper frame joints respectively, wherein two lower ends of said two back frame legs are respectively extended downwardly to pivotally connected to two pivot joints which are affixed to a lower portion of said two side frame legs respectively, moreover a pair of stoppers are respectively affixed at lower portions of said two back frame legs, positioning between said two back upper frame joints and said two pivot joints, so as to block and stop downward movement of said two back upper frame joints while unfolding and stretching out said foldable frame.

13. A foldable frame for beach chair, comprising:

a pair of front frame legs pivotally connected with each other in a cross manner to form a pivotal "X" structure;

a pair of back frame legs pivotally connected with each other in a cross manner to form a pivotal "X" structure two pairs of side frame legs, each pair comprising a first side frame leg and a second side frame leg pivotally connected with each other in a cross manner to form a pivotal "X" structure;

a pair of front lower frame joints for pivotally connecting two lower ends of said two front frame legs with two lower front ends of said side frame legs respectively;

a pair of back lower frame joints for pivotally connecting two lower ends of said two back frame legs with two lower back ends of said side frame legs respectively;

a pair of front upper frame joints for pivotally connecting two upper ends of said two front frame legs with two upper front ends of said side frame legs respectively;

a pair of back upper frame joints for pivotally connecting two upper ends of said two back frame legs with two upper back ends of said side frame legs respectively;

a pair of foldable supporting arms each having a pivot end pivotally connected with one of said two crossed side frame legs of said respective pair of side frame legs in such a manner that a supporting end of each of said supporting arms is extended to bias against said other side frame legs of said respective pair of side frame legs when said foldable frame is unfolded to stretch out, wherein said two pivot ends of said two supporting arms are pivotally connected to upper portions of said two first side frame legs, which are frontwardly extending upwardly, respectively, wherein said two pivot ends of said two supporting arms are pivotally connected to said two second side frame legs, which are frontwardly extending downwardly, respectively, wherein said two supporting ends are extended upwardly in such a manner that each of said two supporting arms has a length and vertically presses against said two first side frame legs respectively when said foldable frame is unfolded to stretch out; and a pair of guider arms for guiding and maintaining said supporting arms to fold and unfold in a vertical manner, wherein one end of each of said guider arms is pivotally connected to a middle position of said respective supporting arm which is pivotally extended from said second side frame leg while another end of each of said guider arms is pivotally connected to said first side frame leg of the same pair of said side frame legs.

14. A foldable frame for beach chair, as recited in claim 13, wherein each of said two supporting arms further has an enlarged rest head affixed to said supporting end thereof to steadily press and bias against said two first side frame legs respectively.

15. A foldable frame for beach chair, as recited in claim 14, wherein each of said rest heads has an inclined end arc surface adapted to sit on said upper curved surface of said respective first side frame leg.

16. The foldable frame, as recited in claim 13, further comprising a pair of inclined back frame legs slidably penetrating through said two back upper frame joints respectively, wherein two lower ends of said two back frame legs are respectively extended downwardly to pivotally connected to two pivot joints which are affixed to a lower portion of said two side frame legs respectively, moreover a pair of stoppers are respectively affixed at lower portions of said two back frame legs, positioning between said two back upper frame joints and said two pivot joints, so as to block and stop downward movement of said two back upper frame joints while unfolding and stretching out said foldable frame.

17. A foldable frame for beach chair, comprising:

a pair of front frame legs pivotally connected with each other in a cross manner to form a pivotal "X" structure;

a pair of back frame legs pivotally connected with each other in a cross manner to form a pivotal "X" structure two pairs of side frame legs, each pair comprising a first side frame leg and a second side frame leg pivotally connected with each other in a cross manner to form a pivotal "X" structure;

a pair of front lower frame joints for pivotally connecting two lower ends of said two front frame legs with two lower front ends of said side frame legs respectively;

a pair of back lower frame joints for pivotally connecting two lower ends of said two back frame legs with two lower back ends of said side frame legs respectively;

a pair of front upper frame joints for pivotally connecting two upper ends of said two front frame legs with two upper front ends of said side frame legs respectively;

a pair of back upper frame joints for pivotally connecting two upper ends of said two back frame legs with two upper back ends of said side frame legs respectively; and a pair of foldable supporting arms, wherein two pivot ends of said two supporting arms are pivotally connected to upper portions of said two front frame legs respectively while two supporting ends of said two supporting arms are vertically extended downwardly to bias against lower portions of said two front frame legs respectively when said foldable frame is unfolded to stretch out.

18. The foldable frame, as recited in claim 17, wherein each of said two supporting arms further has an enlarged rest head affixed to said supporting end thereof to steadily press and bias against said two front frame legs respectively.

19. The foldable frame, as recited in claim 18, wherein each of said rest heads has an inclined end arc surface adapted to sit on an upper curved surface of said respective front frame leg.

20. The foldable frame, as recited in claim 17, further comprising a pair of guider arms for guiding and maintaining said supporting arms to fold and unfold in a vertical manner, wherein one end of each of said guider arms is pivotally connected to said respective front frame leg while said other end of each of said guider arms is pivotally connected to said respective supporting arm.

21. The foldable frame, as recited in claim 20, wherein each of said two supporting arms further has an enlarged rest head affixed to said supporting end thereof to steadily press and bias against said two front frame legs respectively.

22. The foldable frame, as recited in claim 21, wherein each of said rest heads has an inclined end arc surface adapted to sit on an upper curved surface of said respective front frame leg.

23. The foldable frame, as recited in claim 17, further comprising a pair of inclined back frame legs slidably penetrating through said two back upper frame joints respectively, wherein two lower ends of said two back frame legs are respectively extended downwardly to pivotally connected to two pivot joints which are affixed to a lower portion of said two side frame legs respectively, moreover a pair of stoppers are respectively affixed at lower portions of said two back frame legs, positioning between said two back upper frame joints and said two pivot joints, so as to block and stop downward movement of said two back upper frame joints while unfolding and stretching out said foldable frame.

24. A foldable frame for beach chair, comprising:

a pair of front frame legs pivotally connected with each other in a cross manner to form a pivotal "X" structure;

a pair of back frame legs pivotally connected with each other in a cross manner to form a pivotal "X" structure two pairs of side frame legs, each pair comprising a first side frame leg and a second side frame leg pivotally connected with each other in a cross manner to form a pivotal "X" structure;

a pair of front lower frame joints for pivotally connecting two lower ends of said two front frame legs with two lower front ends of said side frame legs respectively;

a pair of back lower frame joints for pivotally connecting two lower ends of said two back frame legs with two lower back ends of said side frame legs respectively;

a pair of front upper frame joints for pivotally connecting two upper ends of said two front frame legs with two upper front ends of said side frame legs respectively;

a pair of back upper frame joints for pivotally connecting two upper ends of said two back frame legs with two upper back ends of said side frame legs respectively; and a pair of foldable supporting arms, wherein two pivot ends of said two supporting arms are pivotally connected to lower portions of said two front frame legs respectively while two supporting ends of said two supporting arms are vertically extended upwardly to bias against upper portions of said two front frame legs respectively when said foldable frame is unfolded to stretch out.

25. The foldable frame, as recited in claim 24, wherein each of said two supporting arms further has an enlarged rest head affixed to said supporting end thereof to steadily press and bias against said two front frame legs respectively.

26. The foldable frame, as recited in claim 25, wherein each of said rest heads has an inclined end arc surface adapted to sit on a lower curved surface of said respective front frame leg.

27. The foldable frame, as recited in claim 24, further comprising a pair of guider arms for guiding and maintaining said supporting arms to fold and unfold in a vertical manner, wherein one end of each of said guider arms is pivotally connected to said respective front frame leg while said other end of each of said guider arms is pivotally connected to said respective supporting arm.

28. The foldable frame, as recited in claim 27, wherein each of said two supporting arms further has an enlarged rest head affixed to said supporting end thereof to steadily press and bias against said two front frame legs respectively.

29. The foldable frame, as recited in claim 28, wherein each of said rest heads has an inclined end arc surface adapted to sit on a lower curved surface of said respective front frame leg.

30. The foldable frame, as recited in claim 24, further comprising a pair of inclined back frame legs slidably penetrating through said two back upper frame joints respectively, wherein two lower ends of said two back frame legs are respectively extended downwardly to pivotally connected to two pivot joints which are affixed to a lower portion of said two side frame legs respectively, moreover a pair of stoppers are respectively affixed at lower portions of said two back frame legs, positioning between said two back upper frame joints and said two pivot joints, so as to block and stop downward movement of said two back upper frame joints while unfolding and stretching out said foldable frame.

* * * * *